US012624850B2

(12) United States Patent
Wang

(10) Patent No.: US 12,624,850 B2
(45) Date of Patent: May 12, 2026

(54) UVC STERILIZATION AND LIGHTING DEVICE

(71) Applicant: ETi Solid State Lighting Inc., Flowery Branch, GA (US)

(72) Inventor: Donglei Wang, Flowery Branch, GA (US)

(73) Assignee: ETI SOLID STATE LIGHTING INC., Flowery Branch, GA (US)

( * ) Notice: Subject to any disclaimer, the term of this patent is extended or adjusted under 35 U.S.C. 154(b) by 829 days.

(21) Appl. No.: 17/856,295

(22) Filed: Jul. 1, 2022

(65) Prior Publication Data

US 2023/0235901 A1 Jul. 27, 2023

Related U.S. Application Data

(60) Provisional application No. 63/217,467, filed on Jul. 1, 2021.

(51) Int. Cl.

| | |
|---|---|
| ***F24F 8/22*** | (2021.01) |
| ***F24F 8/10*** | (2021.01) |
| ***F24F 8/80*** | (2021.01) |

(52) U.S. Cl.

CPC ..... *F24F 8/22* (2021.01); *F24F 8/80* (2021.01); *F24F 8/10* (2021.01); *F24F 2221/02* (2013.01); *F24F 2221/14* (2013.01); *F24F 2221/17* (2013.01)

(58) Field of Classification Search

CPC ..... F24F 8/22; F24F 8/80; F24F 8/10

See application file for complete search history.

(56) References Cited

U.S. PATENT DOCUMENTS

| | | | |
|---|---|---|---|
| 7,763,211 | B2 | 7/2010 | Mcellen |
| 8,961,890 | B2 | 2/2015 | Kim |
| 9,010,019 | B2 | 4/2015 | Mittelmark |
| 10,363,327 | B2 | 7/2019 | Liao |
| 10,933,148 | B1 | 3/2021 | Patterson |
| 11,007,292 | B1 | 5/2021 | Grenon et al. |
| 2021/0003317 | A1 | 1/2021 | Polidoro |

FOREIGN PATENT DOCUMENTS

| | | | | |
|---|---|---|---|---|
| CN | 207364825 | | 5/2018 | |
| CN | 211716396 | | 10/2020 | |
| CN | 212547698 | | 2/2021 | |
| CN | 212842078 | U * | 3/2021 | |
| DE | 102013102121 | A1 * | 9/2014 | ..... F21V 33/0088 |

OTHER PUBLICATIONS

English translation for CN-212842078-U (Year: 2021).*
English translation for DE-102013102121-A1 (Year: 2014).*
"Purelight Lug Hybrid" Group in catalogue: UV-C Luminaires, Lug, May 14, 2021, pp. 1-4.
"Room sterilization solutions," Purelight Lug Technology Protection against viruses, Oct. 31, 2021; accessed at https://luglightfactory.eu/en/uv-c/.

* cited by examiner

*Primary Examiner* — Sean E Conley
(74) *Attorney, Agent, or Firm* — McDonald Hopkins LLC

(57) ABSTRACT

Lighting device that provides, in addition to effective LED illumination, controlled UVC treatment of an airflow that provides sterilization of the air without endangering those using the illumination or damaging the environment being illuminated. Some embodiments include variable light and sterilization control, with variables being timing, intensity and light color, for example.

11 Claims, 11 Drawing Sheets

UVC STERILIZATION AND LIGHTING DEVICE

CROSS REFERENCE TO RELATED APPLICATION

This application claims priority to the U.S. Provisional Patent Application Ser. No. 63/217,467, filed Jul. 1, 2021, entitled "UVC STERILIZATION AND LIGHTING DEVICE", which is incorporated herein by reference in its entirety.

FIELD OF THE INVENTION

This invention relates to ultraviolet sterilization and LED lighting devices, and in particular to such devices that can sterilize air and provide illumination while rendering the places in which the inventive devices are used, safe to people and animals.

BACKGROUND OF THE INVENTION

Description of the Prior Art

Let there be light—and since that phrase was uttered, ingenuity has been called forth to do so in man's own hands, and for a variety of reasons. While traditional lighting for visual aid purposes is perhaps the most known use, other uses of specialized light are also known. Ultraviolet (UV) sterilization devices have been known for over seventy-five years. UV light has been used for sterilizing against the spread of bacteria which cause tuberculosis, for example. Such lamps are referred to as germicidal lamps. Depending on the wavelength, other similar safety-inducing applications have been developed. Ultraviolet-C (UVC) lamps are well-known devices for disinfecting surfaces in homes, places of business, etc., and currently inactivating viruses such as the SARS-CoV-2 coronavirus.

UV spectrums are generally considered to have four parts: UVA (315-400 nm); UVB (280-315 nm); UVC (200-280 nm); and UVVacuum (110-200 nm). It is to be appreciated that natural UVC (for example, from the sun) does not reach the earth from space due to atmospheric scattering, so typically no natural UVC reaches living cells in the skin. UVC kills up to 99.9% of bacteria and viruses.

The Center for Disease Control has defined in the following terms for ultraviolet germicidal irradiation (UVGI):

- Sterilization—a process that destroys all forms of microbial life by physical or chemical methods
- Disinfection—a process that eliminates many or all pathogenic microorganisms on inanimate objects; and
- Decontamination—makes an object or an area safe by removing, neutralizing or destroying any harmful substance—this being the result of sterilization or disinfection.

Continuous low doses of far ultraviolet C (far-UVC) can kill airborne flu viruses without having human access. Far-UVC typically has wavelengths of between 207-227 nm. While perhaps effective in theory against seasonal flu epidemics and pandemics, it is to be appreciated that implementation of overhead far-UVS in all public spaces may be difficult or impossible to enact.

Most materials do not reflect or transmit UVC energies very well. Some specialty glasses made from fused silica are used to direct UVC light. Reflective materials include Teflon, PTFE (polytetrafluorotethylene) and UV-enhanced aluminium. UVC light sources used for disinfection include low pressure mercury-vapor lamps, pulsed-xenon lamps, excimer lamps and UV LEDs.

UVC radiation destroys the outer protein layer of SARS-coronavirus (which differs from SARS-CoV-2 virus) and inactivates the SARS-coronavirus. UVC radiation is believed to be effective in inactivating SARS-CoV-2 virus which causes Covid-19. UVC radiation damages RNA and DNA, stopping microbes (viruses, bacteria, etc.) from replicating. If used correctly, for example with personal protective equipment (PPE), a person may not be damaged by UVC radiation.

UVC radiation inactivates viruses only when the virus is directly exposed to the radiation, and a layer of contaminants, such as for example dust, may prevent the radiation from reaching the virus target. UVC radiation can damage a person's eyes or skin, so it is usually used in ducts to disinfect the air passing through the ducts. One form of eye damage may be that a cornea may be burnt or damaged. Eye damage may also include photoceratitis (or Welder's Flash or Arc Eyes), cataracts, pterygia (inflammatory, invasive and proliferating lesions on the cornea) and pineuecula (yellow deposits between the cornea and sclera). Such damages to a person's eye may occur in as little time as a 3 second exposure. With respect to damage to the skin, the surface of the skin, the epidermis, may be penetrated by UVC. UVC can cause severe skin burns, and excessive exposure to UVC can cause skin cancer.

UVC lamps thus can cause health issues unless the UVC lamps are properly insulated. A person should never look directly at UVC radiation. Some UVC lamps generate toxic mercury and/or ozone, each of which can cause health problems. UVC lamps should emit 254 nm (nanometer), but may emit a broad range of UV wavelengths. Some UVC lamps also emit infrared or visible radiation, and such variations in these emissions may damage persons or animals; however, LED lamps contain no mercury. Germicidal lamps are used because they deactivate the reproductive capabilities of bacteria, viruses and other pathogens when used at 253.7 nm for 10 inches and for 10 seconds. If such lamps generate energy wavelengths, such as 185 nm, to produce ozone, such may result in oxidizing some organic compounds.

Germicidal lamps should be interlocked to prevent access to them while they are running, the interlocks should not be tampered with; a hood latch or equivalent should always be used in a biosafety cabinet (BSC) when the UV lights are on, and the UV lights should be off when a person (or animal) is walking or present in a BSC. PPE should always be worn to reduce or eliminate the hazard of UV lights.

The dangers of UV equipment require training of personnel using the UV equipment. This training is based on dangers to the eyes and skin of personnel; in addition to training, any ventilation requirements of the equipment should be followed. Safety considerations may also include the use of warning signs, the use of UV shields or enclosures and PPE, and there should be an awareness of the symptoms of UV exposure.

Persons should never look directly as UV lamps at any distance. Exposure time to UV lamps should be minimized. Access to UV sources should be restricted. UV lights should be turned off before working on the BSC.

Typical germicidal UVC lamps are good for about two years of continuous use with only 20% decrease in output over the two years. Frequency of starting does not affect the life of UVC lamps. Germicidal UVC lamps do not produce much heat—about the same as fluorescent tubes.

Current general lamps generate energy at 185 nm as well as 254 nm. At 185 nm, significant amounts of ozone are produced which can be helpful since ozone is an extremely active oxidizer and destroys microorganisms on contact. Ozone may also act as a deodorizer. While these attributes may show benefit, ozone should not be used where people are present unless they are wearing PPE, as detriments of ozone to individuals and animals without PPE is to be appreciated.

In addition, germicidal UVC light does shorten the life of plastics, and thus general use—even with human presence excluded for a direction of active use—may not be appropriate.

Semiconductor designs have included a set of LEDs mounted in aluminium gallium nitride (AlGaN) for emitting UVC light near 214 nm, 260 nm and 275 nm. The latter are compact and easily integrated into systems for point-of-use UV disinfection applications.

Germicidal UVC units have been developed for open spaces, for air disinfection and surface disinfection. Some have disinfection chambers to cleanse items such as cell phones to school supplies to medical gear. Robotic UVC systems are used in jet passenger aircraft.

There are a couple of units presently on the market relating to UV disinfection. One is marketed by Acquity Brands, and it involves a germicidal UV lighting technology that kills bacteria and inactivates viruses. Puro Lighting LLC is a lighting and technology company that use Violet Defence technology to create UV disinfection solutions for different industries and different categories. Acquity Brands states that it is offering UV disinfection luminaires with a pulsed xenon lamp and UV transmissive lens, for use in unoccupied spaces to kill bacteria and inactivate viruses. Acquity Brands explains that it is using Ushio's 222 nm far-UVC technology integrated into luminaires. They employ an excimer lamp using a short pass filter to remove harmful wavelengths. Acquity Brands states that it uses "modulated pulses" on the 222 nm UVC to reduce pathogens throughout the day. Acquity Brands states that it uses integrated traditional luminaires in occupied and unoccupied spaces. It further states that no special controls or insulation requirements are required for operation or trained technicians are needed. They state that following threshold limit, values per the ACGIH are used to validate product safety.

Cooper Lighting Solutions has stated that it is marketing a Fail-Safe Surface Disinfection Solutions for direct surface disinfection solutions to inactive viruses, bacteria and mold/fungi. Cooper states that it has in its marketing product, surface disinfection solutions (troffer, strip, linear, high bay, undercabinet, GUV controls). Cooper states that it uses primary and secondary safeguards to deliver UL8802 Safety Certified GUV systems. They state that it is a lamp-based system, for operating up to 9,000 hours while maintaining 80% of initial GUV energy. Cooper also states that it includes Light Architect App as an augmented reality GUV estimator tool. Cooper states that its Upper Air GUV solutions is "safe when properly installed and used as intended," using a proper mounting height. They contend that the upper cavity direct exposure only allows the space to be occupied, and they further say that it is a silent system with room air flow—but without an indication of a fixture creating airflow. They further state that GUV dose levels are calculated until Fluency rate is achieved. They claim that the air disinfection is equivalent to twenty air changes per hour. They go on to say that the lamp base system provides up to 9,000 hours and maintain 80% of initial GUV energy. They further state that these products are cobranded under the SIGNIFY ALCO brand.

Another unit on the market is Hubble Lighting SpectraClean 254 & 405 solutions. These are stated as being targeted as germicidal lighting (254) and targeted as antimicrobial lighting (405). Hubble states that SpectraClean 405 is part of a 2-tier approach with these two solutions. They state that SpectraClean 405 is a "people safe" type of solution for use when used or occupied or non-occupied areas. They contend that it is effective in "combatting germs" like *E. coli, Listeria, Salmonella*, MRSA and STREP. They go on to say that the solution is a combination of Blended=B' UV while maintaining traditional LED light appearance, Blended Plus=B+' which allegedly allows higher UV dosage when unoccupied, Independent=N' which is either high dose UV only mode or white ambient only mode, and Dedicated=D' which is a high dosage UV only luminaire/mode.

Hubble also states that what they refer to as SpectraClean 254, is a UVC system for "people safe" upper air disinfecting. They report that this product is able to disinfect microorganisms and inactivate viruses like SARS-CoV-2, Coxsackle virus B5 & influenza.

The foregoing product is UVC upper air only solutions & UVC upper air with ambient lighting solutions. Hubble continues to report that these rely on standard building and climate control systems to move air into the disinfecting zone. Hubble says that these systems can have enhanced controls for added functionality and safety with their control HUBB APP & NX controls.

Puro Lighting reports that it has on the market a device that is powered by violet defence detect. They state that the violet defence technology has been licensed to create full spectrum UVC-UVB-UVA solutions. It goes on to state that Helo F1 and F2 is designed for in-ceiling or wall mount applications. It is stated that this product is designed to be BACnet compatible to commission with existing BAS controls that can be manually controlled and includes redundant safety and occupancy sensors. They say that the Sentry Cart & Tripod are portable systems. They further contend the PUROBOT UV is an autonomous system that is available for purchase or could be sold as service and they refer to their technical description of UV technology and channel marketing resources.

Another product on the air disinfection market is Big Ass Fans which is marketing an integrated ozone-free ionizers and its haiku fan with integrated upper air UVC. The haiku UVC is alleged to have reduced exposure in a 60-minute class from 39% to 5%, and a teacher's 7-hour day in a classroom, the risk of exposure from 97% to 30%. This company states that it produces fans with integrated ionizers (0 ozone) with independent testing results which kill 99.99% of SARS-CoV-2. They further state that they have a custom speclab design software that shows the exact impact of pathogens for a safer space.

Another product on the market is produced by Orion Energy which has announced an Air Movement UVC Products' licensing agreement with Go Fan Yourself. All that exists so far is a press release. It is stated that they plan to incorporate the foregoing in their ISON line of products utilizing 275 nm UVC wavelengths. They state that these products will compliment its 405 nm products using Vyv technology.

General Electric is marketing a product referred to as 365 DisInFx technology which they are promoting as being "people safe" for a 24-hour occupied use. They further have published material referring to an LPU Series UVC air disinfection. It is stated as being a standalone device for delivering a constant low-dosage 254 nm UVC. GE contends that is operates below human exposure guidelines set by the IEC62471 and ACGIH TLDs at 254 nm over a 24-hour period. They further state that when properly designed, it "should provide" inactivation of SARS-CoV-2. GE goes on to report that it has also on the market an LDU recessed, ADU stripped and LVU downlight series UVA surface disinfection. GE states that the foregoing product emits 365 nm UVA continuous light emitted that is invisible to the eyes and does not impact CCT or CRI. It is also reported as meeting the IEC 62471 & ACGIH TLD guidelines for human exposure to UV and is available in white antimicrobial paint. It goes on to state that when properly designed, it inactivates Staphylococcus Aureus, it reduces it by 40% after six hours, 88% inactivation after twelve hours and 99% inactivation after twenty-four hours. GE states that it is licensing its technology with Leviton.

BRIEF SUMMARY OF THE INVENTION

One goal of the present invention is to provide a UVC sterilization and lighting device for use in a room, with the device having a frame; a front cover, attachable to the frame; a back cover, wherein a portion of the back cover comprises a portion of an air duct, wherein the air duct further comprises a separator and one or more side baffles; a filter that is placed behind one or more air inlets; a fan portion that comprises a fan, a fan cover attached to the fan on an inward side of the fan portion, and a fan net attached to the fan on an outward side of the fan, the outward side of the fan net placed behind one or more air outlets; a UVC treatment portion that is contained within the air duct, and that comprises one more UV lamps, wherein each of the one or more UV lamps are attached to respective lamp holders, and wherein the respective lamp holders are attached to a lamp bracket; one or more plasma modules that power the UV lamps; a plurality of LED lights that are attached to one or more light boards; one or more diffusers that is disposed outwardly of at least one portion of the plurality of LED lights and that is fixably constrained by the frame and the front cover; a drive module that is electrically connected to the fan, the plasma modules and the plurality of LED lights; an indicator that indicates that the UV lamps are powered; and a lock switch that prevents interior access if the UV lamps are powered.

An object of the present invention is to provide a UVC sterilization and lighting device for use in a room that has an LED light including a lighting portion for transmitting illumination, and one or more air inlets that receives untreated air from the room; an air duct; a UVC sterilization portion, located in the air duct, that treats air moving through said air duct with UV radiation to germicidally treat said air, wherein said UVC sterilization portion is not visible to persons in the room; and a fan that transmits treated air through one or more air outlets into the room.

A further object of the invention for the UVC sterilization and lighting device is that the air duct comprises a portion of a back cover, a separator and one or more side baffles.

A still further object of the invention is that the air duct comprises a substrate conducive to UVC treatment for at least one of sterilization, disinfection and decontamination of the received untreated air from the room.

A goal of the invention for the UVC sterilization and lighting device is to have a controls unit that varies one of light intensity, light color, or timing duration of the LED light.

A further goal of the invention is that the controls unit controls powering of the LED light and the UVC sterilization to operate independently of each other.

A still further goal of the invention for the UVC sterilization and lighting device is to have an interlock device that prevents internal access to the device while the UVC sterilization is operating.

According to another object of the present invention, a combination LED light unit and a UVC sterilization device can be provided that has a light emitting assembly; a fan box connected to said light emitting body; a fan located in said fan box; an air duct in operative connection with said fan; an air inlet disposed on one side of said light emitting assembly for drawing contaminated air into said UVC sterilization device from a space; an air outlet disposed on a side of said light body on a different side of said light emitting body from the disposition of said air inlet; a germicidal and disinfecting air purifier apparatus for eliminating pathogens from said air and disinfecting said air from said light emitting body; and said air outlet directing air treated with said germicidal and disinfecting air purifier apparatus back into the space.

A further object of the invention for the UVC sterilization and lighting device is that a form of the device is a UVC 2×2 direct/indirect troffer.

A still further object of the invention for the UVC sterilization and lighting device is that the LED light unit comprises a correlated color temperature control means for selectively controlling the correlated color temperature of the light emitted by the light emitting assembly.

A yet still further object of the invention for the UVC sterilization and lighting device is that a UVC sterilization lamp is within a cavity, the UVC sterilization lamp comprises a UVC-LED, and one or more walls of the cavity comprise a substrate for sterilizing air flowing through said cavity with an output from the UVC sterilization lamp.

Another goal of the present invention is that a combination LED light unit and a UVC sterilization device further includes a night light and a control assembly for instituting and completing one or more the following functions: air sterilization combined with LED lighting; separate LED lighting; night lighting; ventilation in combination with at least one additional function consisting of the group of air sterilization, air sterilization with LED lighting, LED lighting, and night lighting; and the control assembly comprises one or more of a variety of switching devices including wall switches, remote control switches, automatic temperature control switches, motion switches, humidity switches and time switches. These and other objects will be apparent from the description to follow and from the appended claims.

DETAILED DESCRIPTION OF THE PREFERRED EMBODIMENTS

Now turning to the figures, it is to be appreciated that the various embodiments may use one or more of the aspects of the innovation as will be disclosed. It is to be further appreciated that explicit form factors may vary as is known in the art, and that the disclosed innovation may be comprised of items discussed in one or more embodiments without being explicitly mentioned in a single embodiment.

In an embodiment, one or more LED lighting assemblies may be configured such that a completed assembly provides a predetermined amount of LED illumination while also within the same unit provides for UVC processing of an induced air flow. The configuration includes applying the UVC processing to the air flow in a manner in which use of the installed assembly does not allow the UVC to be in "line of sight" of any user in a room in which one or more of the assemblies may be installed. It is to be appreciated that with keeping the UVC light from being "line-of-sight," not only is safety towards persons and animals being maintained, but also objects in the room that receive illumination can avoid suffering UVC degradation. Controls of the various embodiments for both light as illumination and light as sterilization/disinfection/decontamination are provided. It is to be appreciated that while sterilization may be a term that is used, it is contemplated that other embodiments can employ one or more of sterilization, disinfection and decontamination. For example (not shown), a traditional light switch with binary operation may enable both illumination and sterilization. For another example (not shown), a dimmer style switch may be configured to allow variable illumination, variable sterilization or both. For yet another example (not shown), a keypad type of wall control may provide for further detailed control operation. While for simplicity sake, the discussion will focus on a ceiling-installed configuration, it is to be appreciated that other configurations can employ aspects of the innovation and are considered within the scope herein. For example, stand alone or wall mounted units (with appropriate versions of the description) are additional embodiments.

Figure 1:
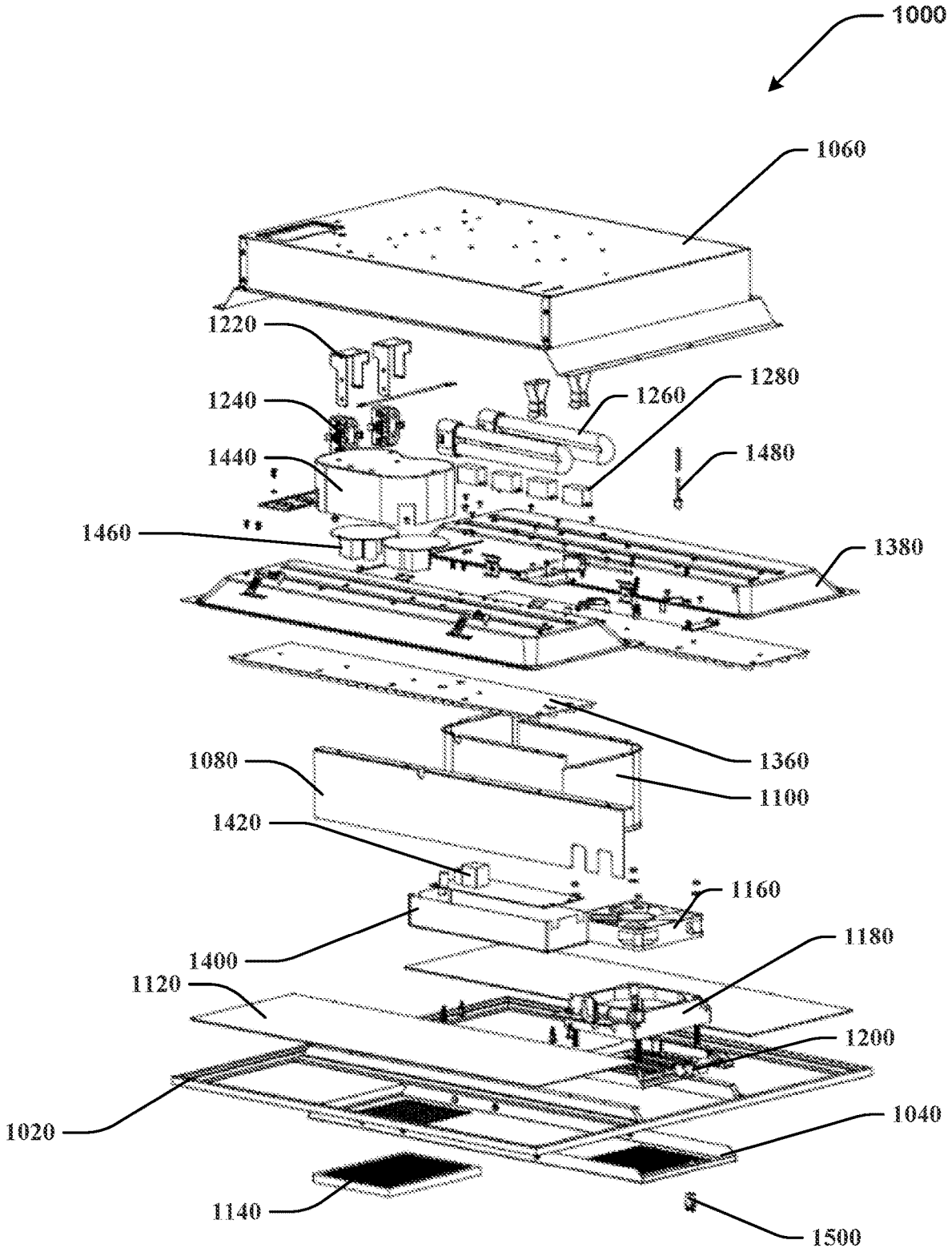
FIG. 1 shows an exploded view of an embodiment of the innovation disclosed herein.

Turning now to FIG. 1, an exploded view of an embodiment of the UVC Sterilization and Lighting Device 1000 of the invention disclosed herein is shown. Embodiment 1000 may be known as model 2×2. Model 2×2 may have a frame 1020. Frame 1020 may be manufactured as may be known in the art for light fixtures. Frame 1020 also may be configured to support one or more illumination areas, as well as airflow features as described herein. Front cover 1040 can attach to frame 1020 and aid in support of the components for sterilization as described herein. An additional structural element is an air duct 1060. Air duct 1060 may also be known as a back cover, and it is to be appreciated that air duct 1060 may have a selected portion that serves—with other components that will be described—as a portion of a total air duct, whole other selected portions of air duct 1060 may serve as a structural cover of various other components and can serve to add structural stability to the overall light fixture of, for example, model 2×2.

Along with air duct 1060, one or more side baffles 1080, and a separator 1100 can form the remainder of the total air duct. It is to be appreciated that these components may be especially formulated for both UVC application (as photocatalysis is known in the art), and for airflow. For example (not shown), internal portions of these components can preferably (or advantageously be formed in a serpentine manner, or may be fabricated with wave or other features that cause a predetermined level of turbulence to the air flow. Such turbulence may be advantageous in that germs and other material in the air flow that could be subject to sterilization, would be exposed to the UVC as opposed to what could happen in a laminar flow. The level of turbulence can be controlled so as to maintain a low level of noise. It is to be appreciated that the structure is fabricated to alleviate most any noise that may arise from vibration, of either the air in the air flow or in the components in the embodiment.

In an embodiment, a filter 1140 (that may be germicidal treated as is known in the art) can be located at the entrance of the total air duct. This is advantageous to assist in reducing dust or other airborne particles that may block the UVC treatment. A fan 1160 may advantageously be located at the other end of the total air duct, and may be operated to draw air through the duct and return the treated air back into the room. In an embodiment, a fan cover 1180 and a fan net 1200 (also known as wind cover and wind net) can be used to cover and protect the fan. In embodiments, these can also serve to ensure that no UVC obtains a line-of-sight path from a treatment zone within the total air duct by blocking a visual path inward, verifying that no UVC escapes the interior of the unit. UVC treatment can be provided with lamp bracket 1220 fastening lamp holder 1240 that holds one or more UV lamps 1260. One or more plasma modules 1280 provide energy to UV lamps 1260. It is to be appreciated that air duct 1060 may also have a photocatalyst coating. It is also to be appreciated that additional baffles may be configured into the total air duct. While the present discussion calls these side baffles, it is to be understood that configurations are limited to use of these on the side of the total air duct. It is also to be appreciated that the number of UV lights (or plasma modules or both) may be configured for different expected concentrations of items in the air flow to which UVC treatment is applied. For example, a different configuration for a busy hospital than for an area expecting light traffic can provide different embodiments. Further, configuration of one or more air inlets and exits may be modified in various embodiments.

Also configured in an embodiment, a plurality of LED lighting modules 1360 can be attached to a light board 1380. Diffuser 1120 can provide a desired distribution for various illumination effects from light from the LED lighting modules 1360. It is to be appreciated that control of the UVC treatment (including airflow) and illumination by way of the LED lighting modules 1360 may be configured with a large variety—while the embodiment shown in the figure is one such configuration.

Continuing with model 2×2, a driver box 1400 can contain a drive module 1420, and a ballast box 1440 can contain a ballast 1460. It is to be appreciated that as known in the art, the use or removal of a ballast box 1440 and ballast 1460 may reflect a chosen manner of electrically connecting one or more model 2×2's in a room. Further embodiments can include an indicator 1480 that can indicate that UVC treatment is active. An embodiment can also include a lock switch 1500 that can be configured for safety in that if UVC treatment is active, then the lock switch 1500 prevents access to the inner portion of model 2×2, thereby preventing accidental exposure. It is to be appreciated that other controls (not shown) may also be employed. For example (not shown), a unit may be equipped with a nightlight or emergency light that may be used in addition to the LED illumination lights (or the LED illumination lights may be additionally controlled to provide these types of illumination). An embodiment may be equipped with presence monitor or motion sensors. Programmed controls may employ a more vigorous action of UVC with reduced LED illumination, for example, if a lack of presence or motion is detected. In another embodiment, a filter sensor may be configured to indicate when a filter change would be beneficial, or when a more vigorous application of UVC treatment may be desired.

Figure 2:
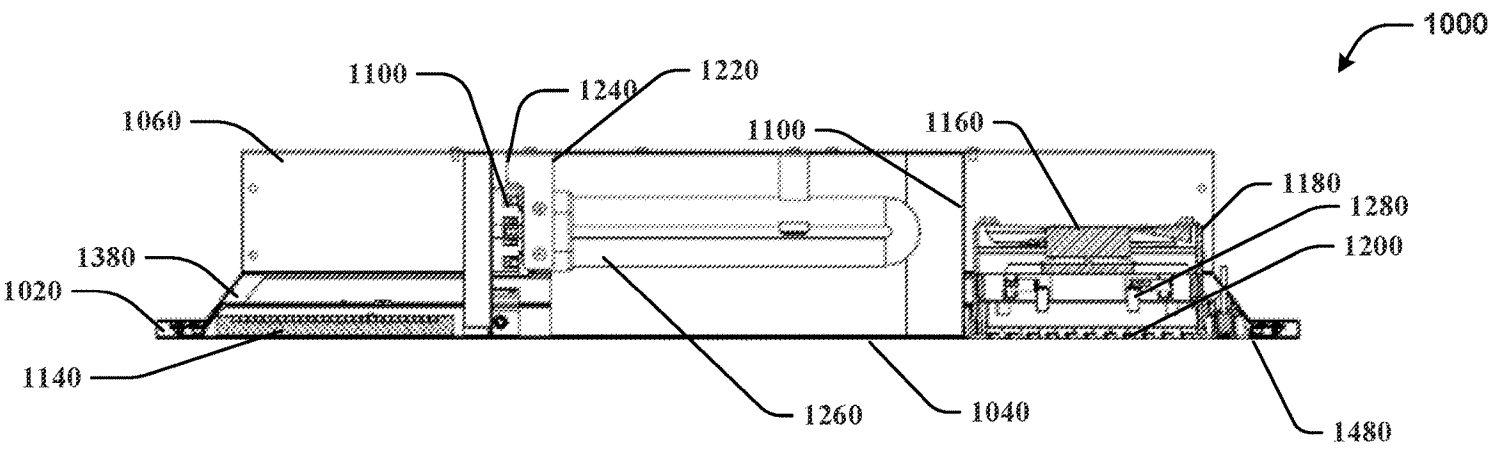
FIG. 2 shows a side view of the embodiment of FIG. 1, with a view into the interior.
Figure 3:
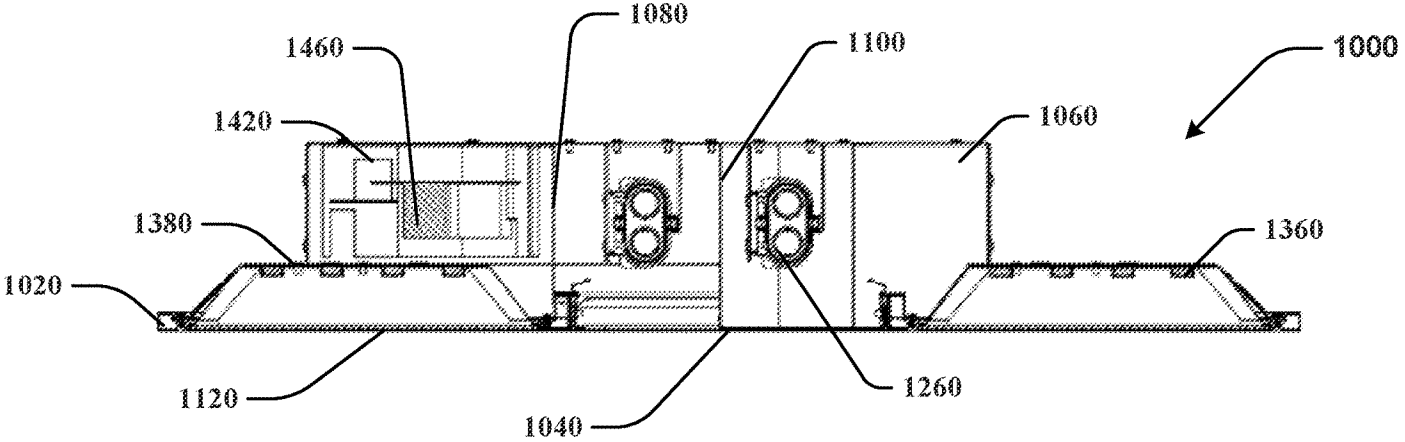
FIG. 3 shows a separate side view of the embodiment of FIG. 1, with a view into the interior.

Turning to FIGS. 2 and 3, two side views of the embodiment shown in FIG. 1 are portrayed to show some interior placement of components. In FIG. 2, frame 1020 and front cover 1040 mate with air duct 1060. An internal view, as shown in FIGS. 2 and 3, reveals separator 1100, filter 1140, fan 1160, fan cover 1180, and fan net 1200. Also shown are lamp bracket 1220, lamp holder 1240, UV lamp 1260, and plasma module 1280. Also shown is light board 1380 and indicator 1480. In FIG. 3, a view rotated approximately ninety degrees for model 2×2, the placement of the frame 1020, front cover 1040 and air duct 1060 (seen on edge) form the structural shell of model 2×2. In this view, side baffle 1080, separator 1100 and diffuser 1120 can be seen, as well as UV lamp 1260. LED lighting module 1360 and light board 1380 are pictured. Also pictured are drive module 1420 and in this embodiment ballast 1460. It is to be appreciated that other components (in various quantities) may be present in other embodiments, and that these figures provide an example.

Figure 4:
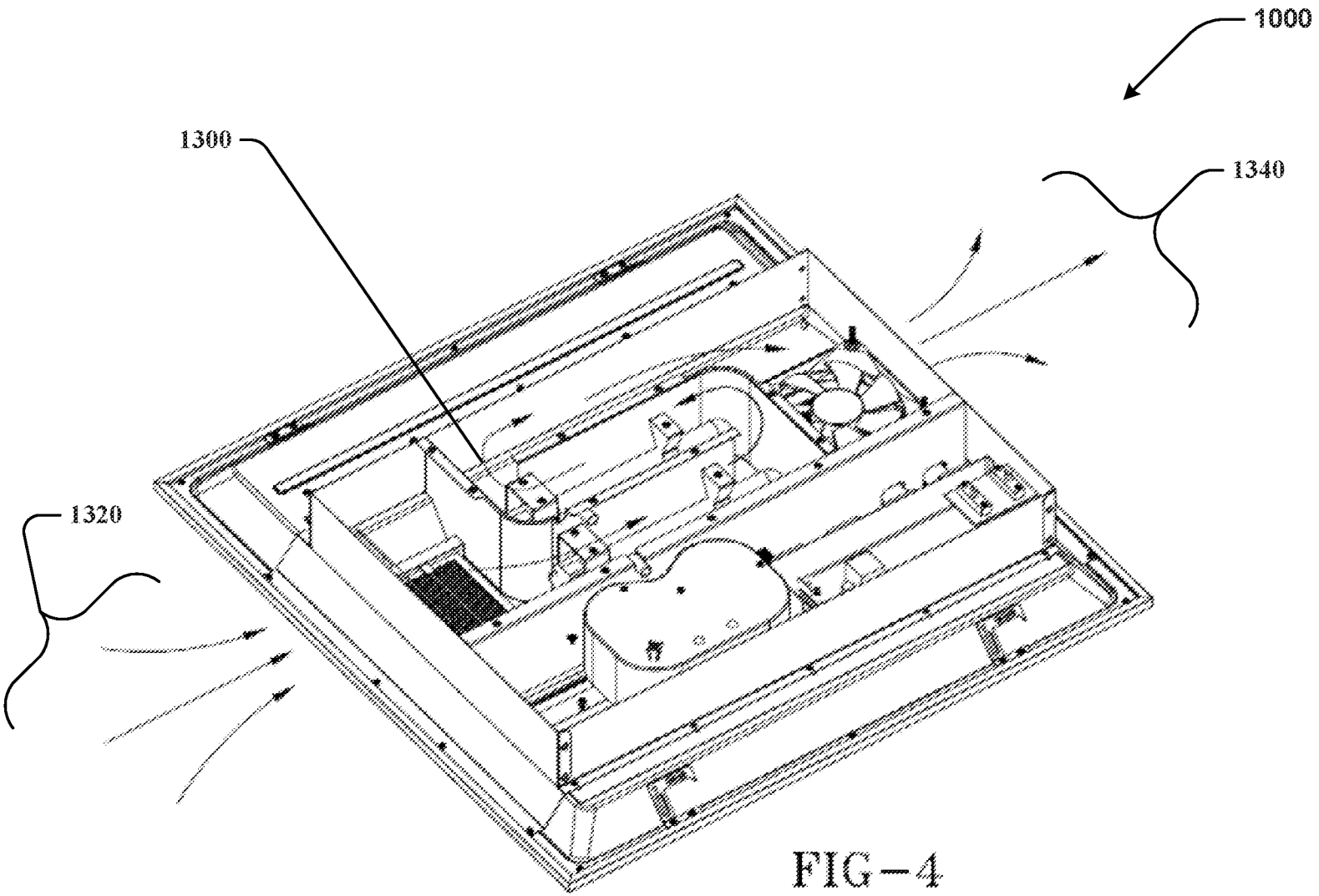
FIG. 4 shows an isometric view with partial cutaway of the embodiment of FIG. 1 that highlights an air path through the embodiment.

Turning to FIG. 4, an isometric view is shown with partial cutaway of the embodiment of FIG. 1 highlights an air path, indicated by a set of schematic arrows, through the embodiment. It is to be appreciated that air flow 1300 is within the device after entering at air inlet 1320 (through a filter), and drawn by a fan passes through a UVC treatment zone. The fan expels the treated air at air outlet 1340 back into the room.

Figure 5:
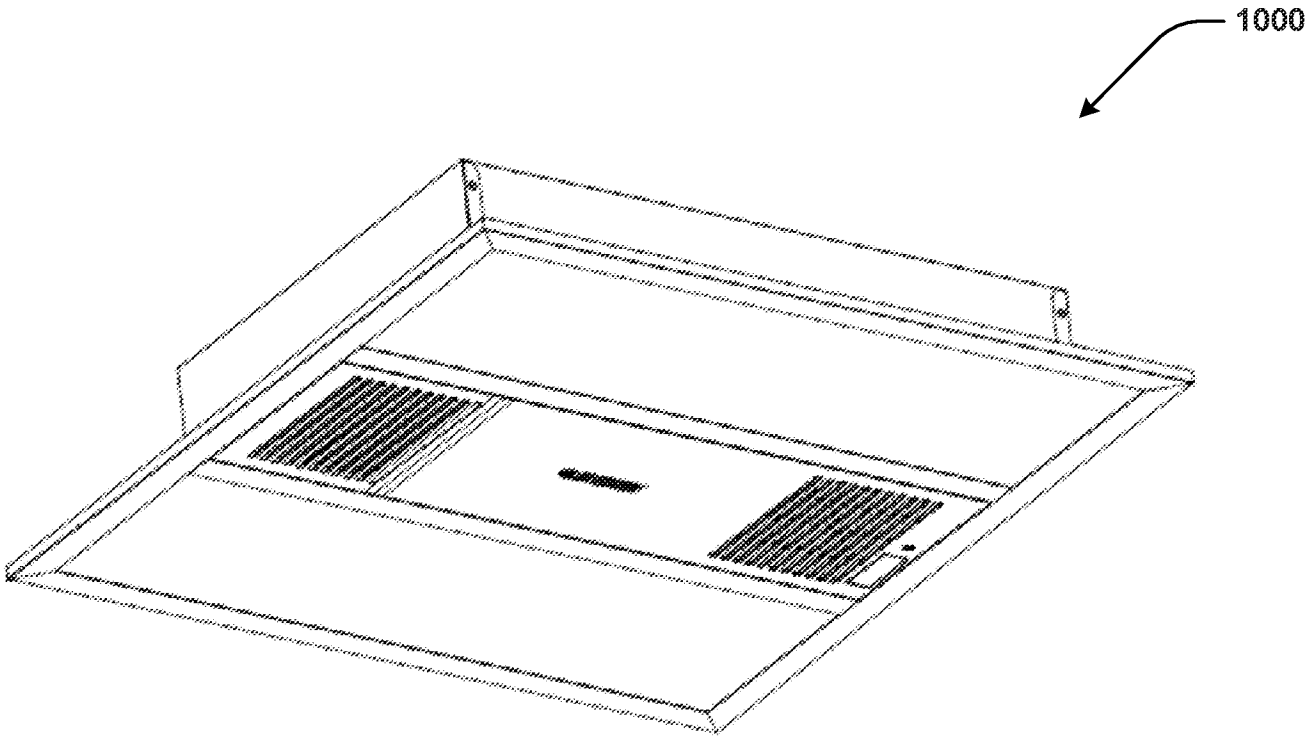
FIG. 5 shows an isometric view of the embodiment of FIG. 1, from a viewpoint of a user below the embodiment.
Figure 6:
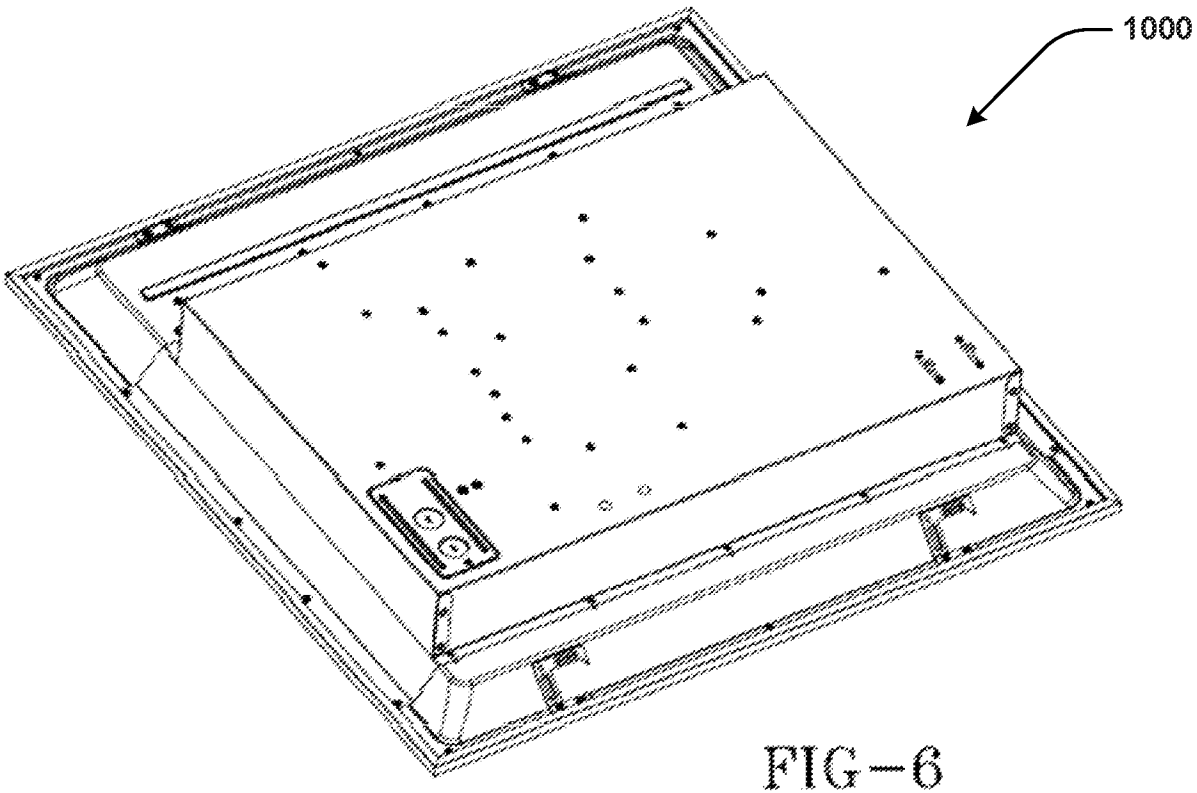
FIG. 6 shows an isometric view with perspective similar to FIG. 4, but without a cut-away.

FIGS. 5 and 6 provide additional isometric views of an example embodiment of model 2×2. It is to be appreciated from these views that no line-of-sight path of UVC treatment can reach a person in a room that is being treated with one or more model 2×2's, and that an indicator is easily visible along with a lockout switch. In FIG. 6, it is to be appreciated that power connections and fastening areas can be provided or attached to frame 1020 or air duct 1060 as may be known in the art.

Figure 7:
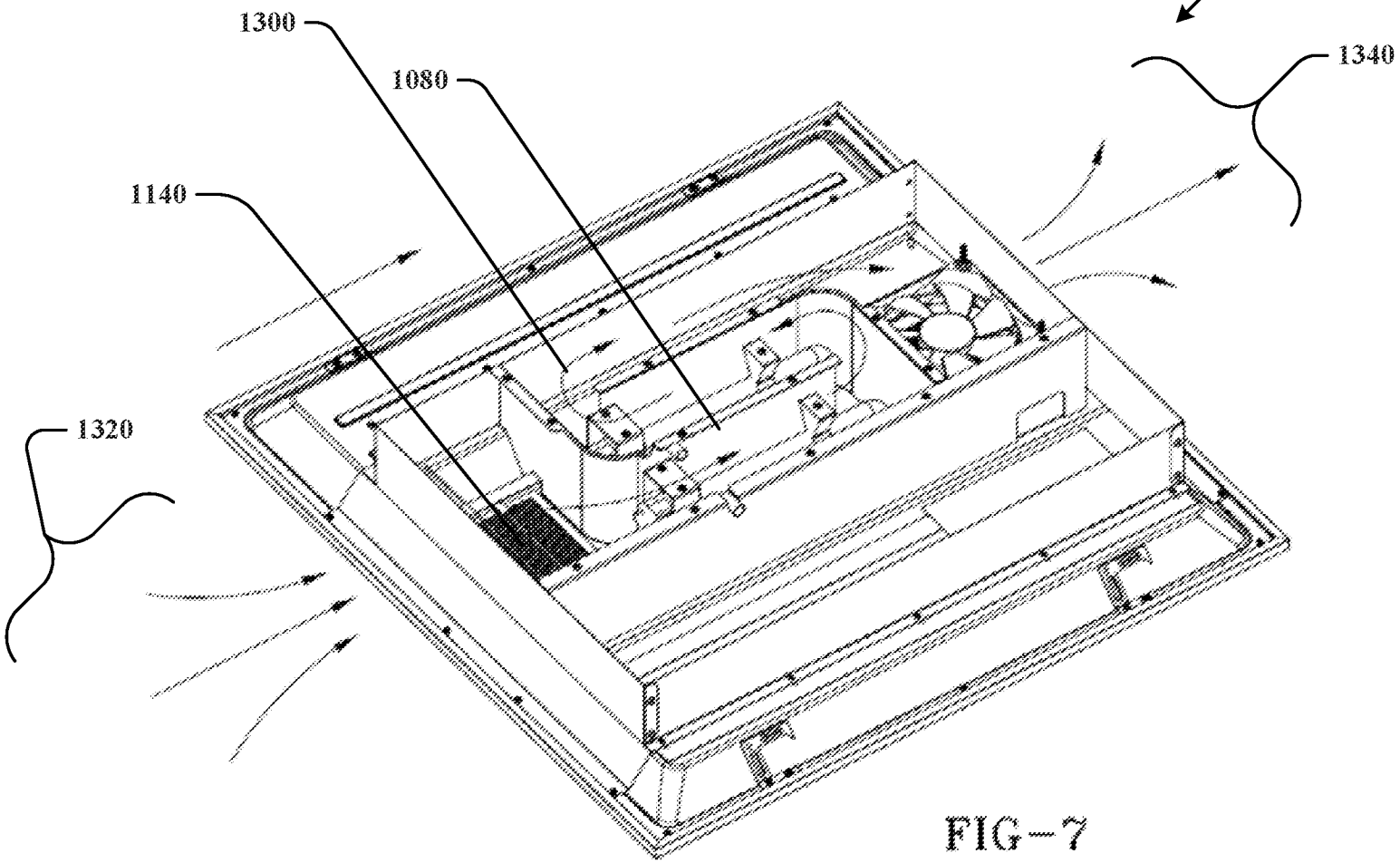
FIG. 7 shows an isometric view similar to FIG. 4 with another embodiment without a ballast configuration.

FIG. 7 shows an isometric view similar to FIG. 4 with another embodiment without a ballast configuration. As has been disclosed, whether or not an embodiment is provided with a ballast may be a configuration choice. It is to be appreciated that air flow 1300 is within the device after entering at air inlet 1320 (through filter 1140), and drawn by fan 1160 passes through a UVC treatment zone. The fan expels the treated air at air outlet 1340 back into the room.

Figure 8:
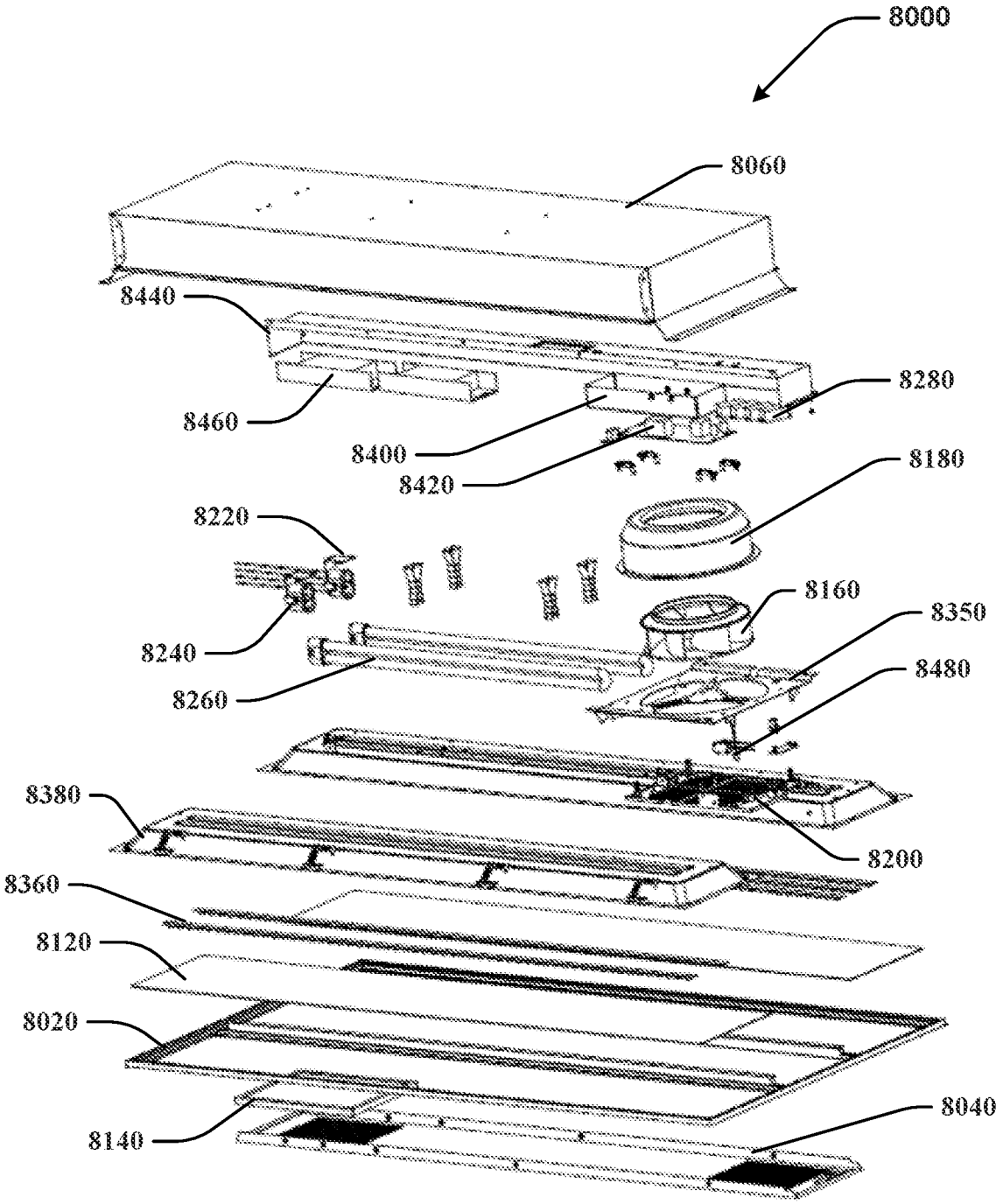
FIG. 8 shows an exploded view of an embodiment of the innovation disclosed herein.

Turning to FIG. 8, an exploded view of another embodiment of the UVC Sterilization and Lighting Device 8000 of the invention disclosed herein is shown. Embodiment 8000 may be known as model 2×4. Model 2×4 may have a frame 8020. Frame 8020 may be manufactured as may be known in the art for light fixtures. Frame 8020 also may be configured to support one or more illumination areas, as well as airflow features as described herein. Front cover 8040 can attach to frame 8020 and aid in support of the components for sterilization as described herein. An additional structural element is air duct 8060. Air duct 8060 may also be known as a back cover, and it is to be appreciated that air duct 8060 may have a selected portion that serves—with other components that will be described—as a portion of a total air duct, whole other selected portions of air duct 8060 may serve as a structural cover of various other components and can serve to add structural stability to the overall light fixture of, for example, model 2×4.

Along with air duct 8060, one or more side baffles 8080, and separator 8100 can form the remainder of the total air duct. It is to be appreciated that these components may be especially formulated for both UVC application (as photocatalysis is known in the art), and for airflow. For example (not shown), internal portions of these components may be formed in a serpentine manner, or may be fabricated with wave or other features that cause a predetermined level of turbulence to the air flow. Such turbulence may be advantageous in that germs and other material in the air flow to be subject to sterilization would be exposed to the UVC as opposed to what can happen in a laminar flow. The level of turbulence can be controlled so as to maintain a low level of noise. It is to be appreciated that the structure is fabricated to alleviate most any noise that may arise from vibration, of either the air in the air flow or in the components in the embodiment.

In an embodiment, a filter 8140 (that may be germicidal treated as is known in the art) can be located at the entrance of the total air duct. This is advantageous to assist in reducing dust or other airborne particles that may block the UVC treatment. A fan 8160 may be located at the other end of the total air duct, and may be operated to draw air through the duct and return the treated air back into the room. In an embodiment, fan cover 8180 and fan net 8200 (also known as wind cover and wind net) can be used to cover and protect the fan. In addition, fixed board 8350 may be provided. It is to be appreciated that in embodiments, these can also serve to ensure that no UVC obtains a line-of-sight path from a treatment zone within the total air duct. UVC treatment can be provided with lamp bracket 8220 fastening lamp holder 8240 that holds one or more UV lamps 8260. One or more plasma modules 8280 provide energy to UV lamps 8260. It is to be appreciated that air duct 8060 may also have a photocatalyst coating. It is also to be appreciated that additional baffles may be configured into the total air duct. While the discussion calls these side baffles, it is to be understood that configurations are limited to use of these on the side of the total air duct. It is also to be appreciated that the number of UV lights (or plasma modules or both) may be configured for different expected concentrations of items in the air flow to which UVC treatment is applied. For example, a different configuration for a busy hospital than for an area expecting light traffic can provide different embodiments. Further, configuration of air inlet and exits may be modified in various embodiments.

Also configured in an embodiment, a plurality of LED lighting modules 8360 can be attached to a light board 8380. Diffuser 8120 can provide a desired distribution for various illumination effects from light from the LED lighting modules 8360. It is to be appreciated that control of the UVC treatment (including airflow) and illumination by way of the LED lighting modules 8360 may be configured with a large amount of variety—while the embodiment shown in the figure is one such configuration.

Continuing with model 2×4, a driver box 8400 can contain a drive module 8420 and a ballast box 8440 can contain a ballast 8460. It is to be appreciated that as known in the art, the use or removal of a ballast box 8440 and ballast 8460 may reflect a chosen manner of electrically connecting one or more model 2×4's in a room. It is also to be appreciated that ballast box 8440 may be configured to secure more than a ballast 8460, and may serve as an electrical box or support for the unit. Further embodiments can include an indicator 8480 that can indicate that UVC treatment is active. An embodiment can also include a lock switch 8500 that can be configured for safety in that if UVC treatment is active, then the lock switch 8500 prevents access to the inner portion of model 2×4, thereby preventing accidental exposure. It is to be appreciated that other controls (not shown) may also be employed. For example (not shown), a unit may be equipped with a nightlight or emergency light that may be used in addition to the LED illumination lights (or the LED illumination lights may be additionally controlled to provide these types of illumination). An embodiment may be equipped with presence monitor or motion sensors. Programmed controls may employ a more vigorous action of UVC with reduced LED illumination, for example, if a lack of presence or motion is detected. In another embodiment, a filter sensor may be configured to indicate when a filter change would be beneficial, or when a more vigorous application of UVC treatment may be desired.

Figure 9:
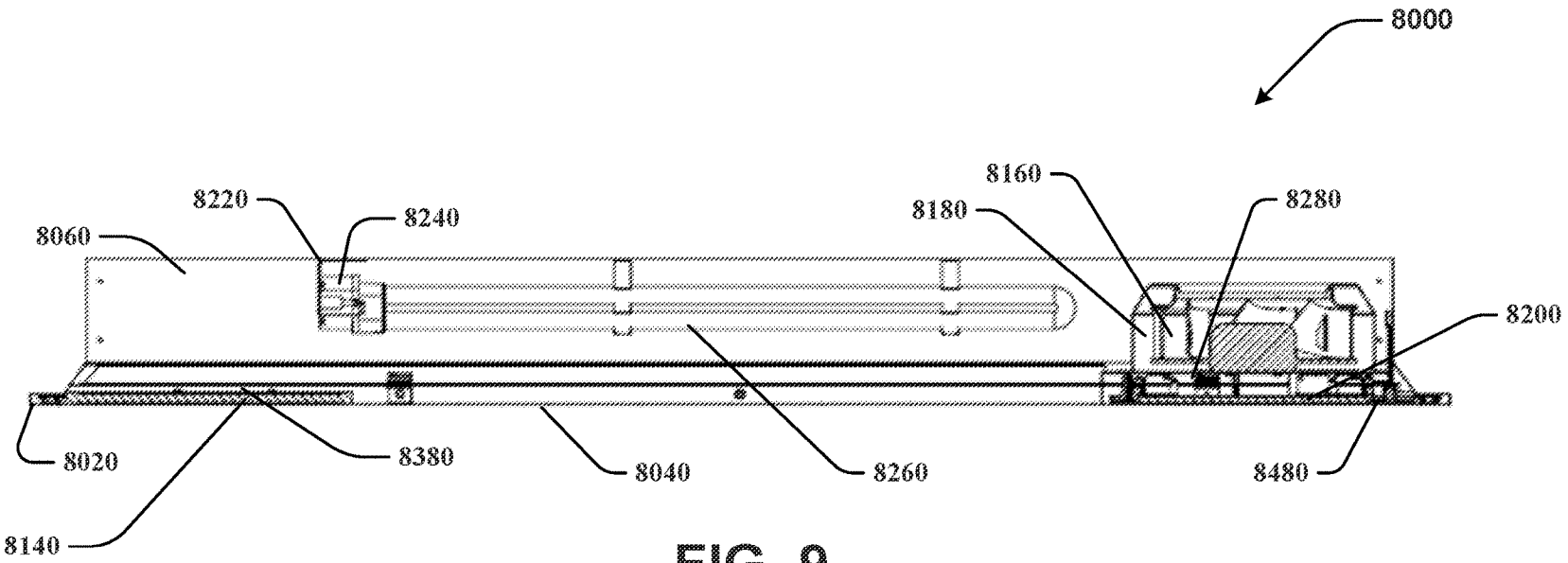
FIG. 9 shows a side view of the embodiment of FIG. 8, with a view into the interior.
Figure 10:
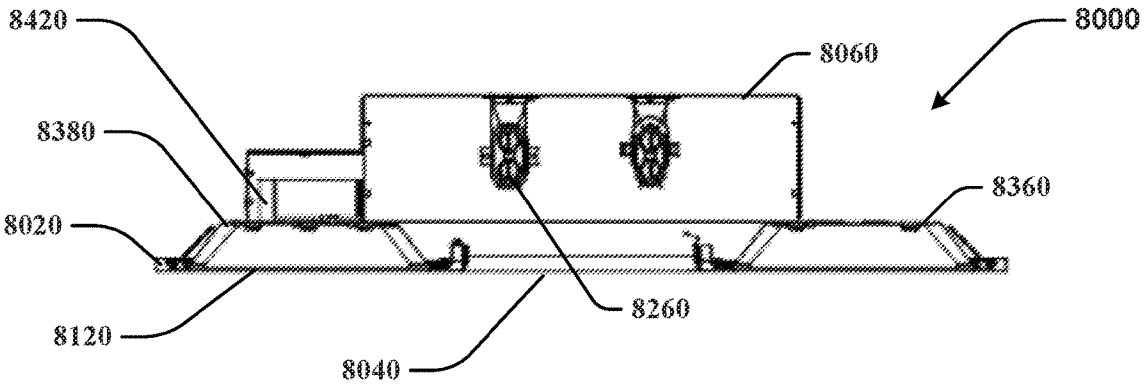
FIG. 10 shows a separate side view of the embodiment of FIG. 8, with a view into the interior.

Turning to FIGS. 9 and 10, two side views of the embodiment shown in FIG. 8 are portrayed to show some interior placement of components. In FIG. 9, frame 8020 and front cover 8040 mate with air duct 8060. Internal view reveals filter 8140, fan 8160, fan cover 8180, and fan net 8200. Also shown are lamp bracket 8220, lamp holder 8240, UV lamp 8260, and plasma module 8280. Also shown is light board 8380 and indicator 8480. In FIG. 10, a view rotated approximately ninety degrees for model 2×4, the placement of the frame 8020, front cover 8040 and air duct 8060 (seen on edge) form the structural shell of model 2×4. In this view, diffuser 8120 can be seen, as well as UV lamp 8260. LED lighting module 8360 and light board 8380 are pictured. Also pictured are drive module 8420. It is to be appreciated that other components (in various quantities) may be present in other embodiments, and that these figures provide an example.

Figure 11:
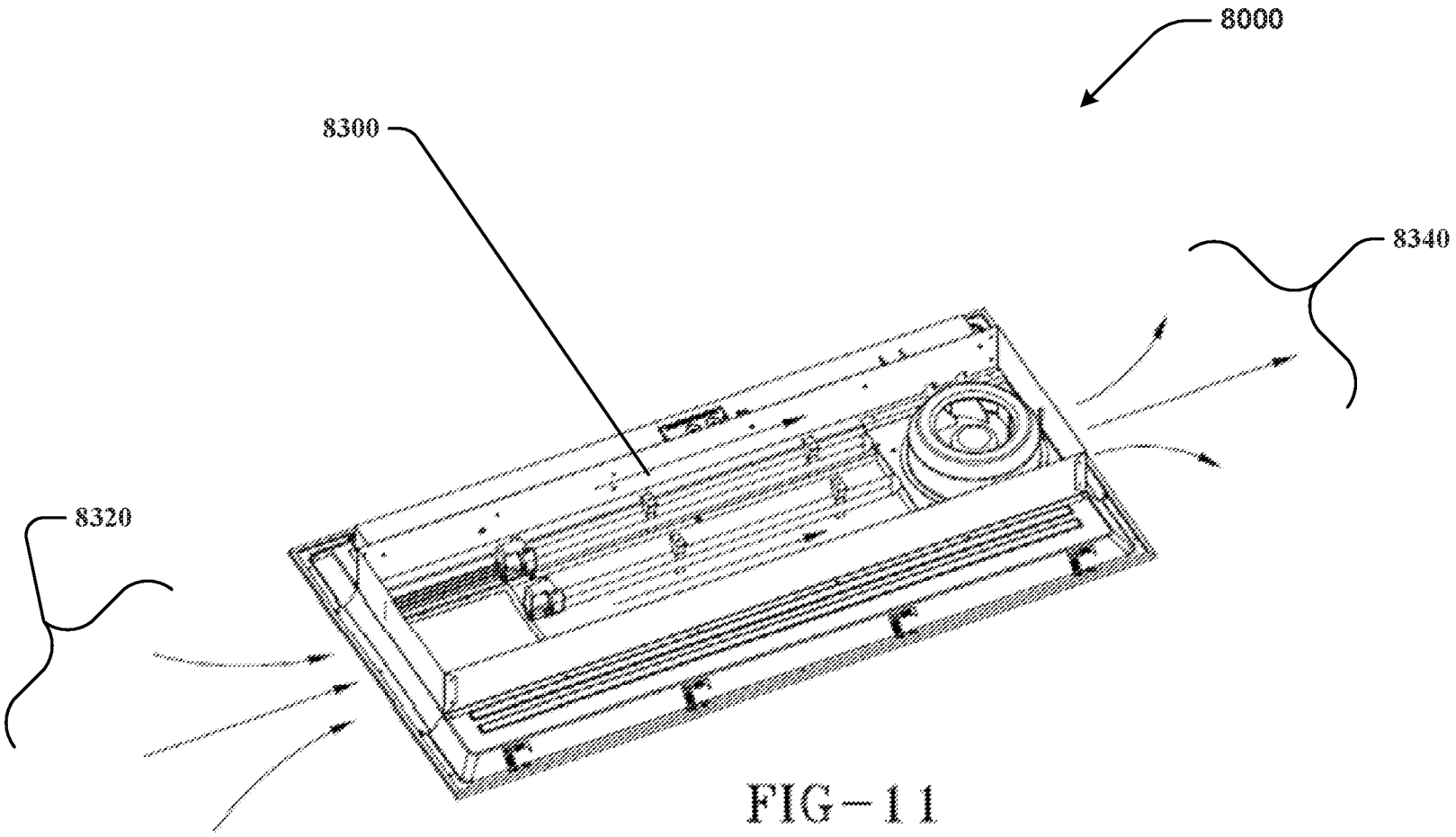
FIG. 11 shows an isometric view with partial cutaway of the embodiment of FIG. 8 that highlights an air path through the embodiment.

Turning to FIG. 11, an isometric view with partial cutaway of the embodiment of FIG. 8 that highlights an air path through the embodiment is shown. It is to be appreciated that air flow 8300 is within the device after entering at air inlet 8320 (through a filter), and drawn by a fan passes through a UVC treatment zone. The fan expels the treated air at air outlet 8340 back into the room.

Figure 12:
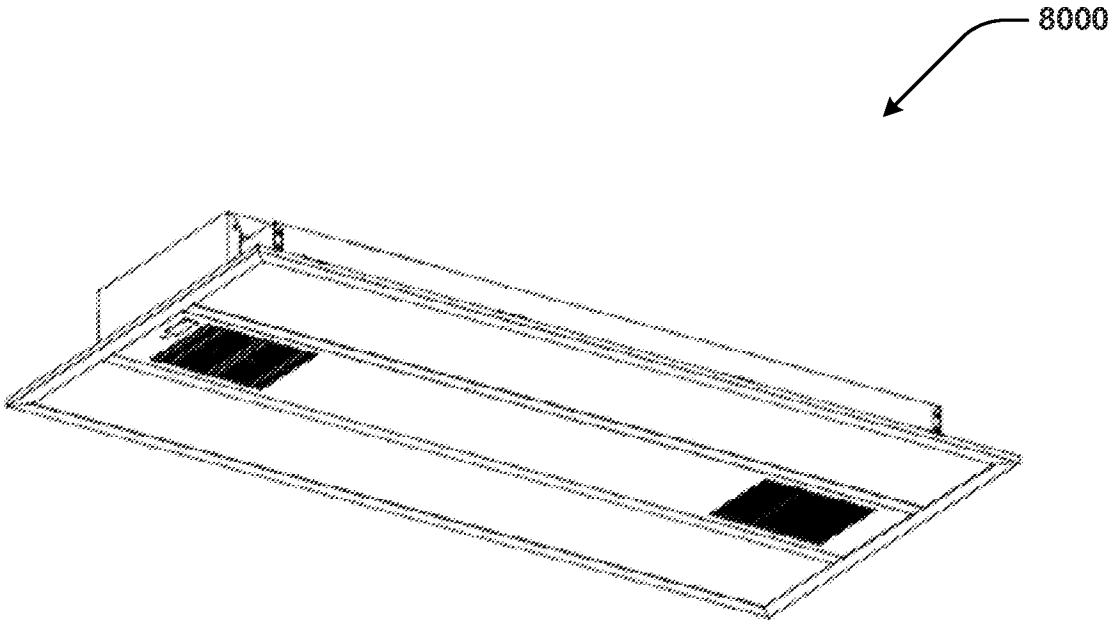
FIG. 12 shows an isometric view of the embodiment of FIG. 8, from a viewpoint of a user below the embodiment.
Figure 13:
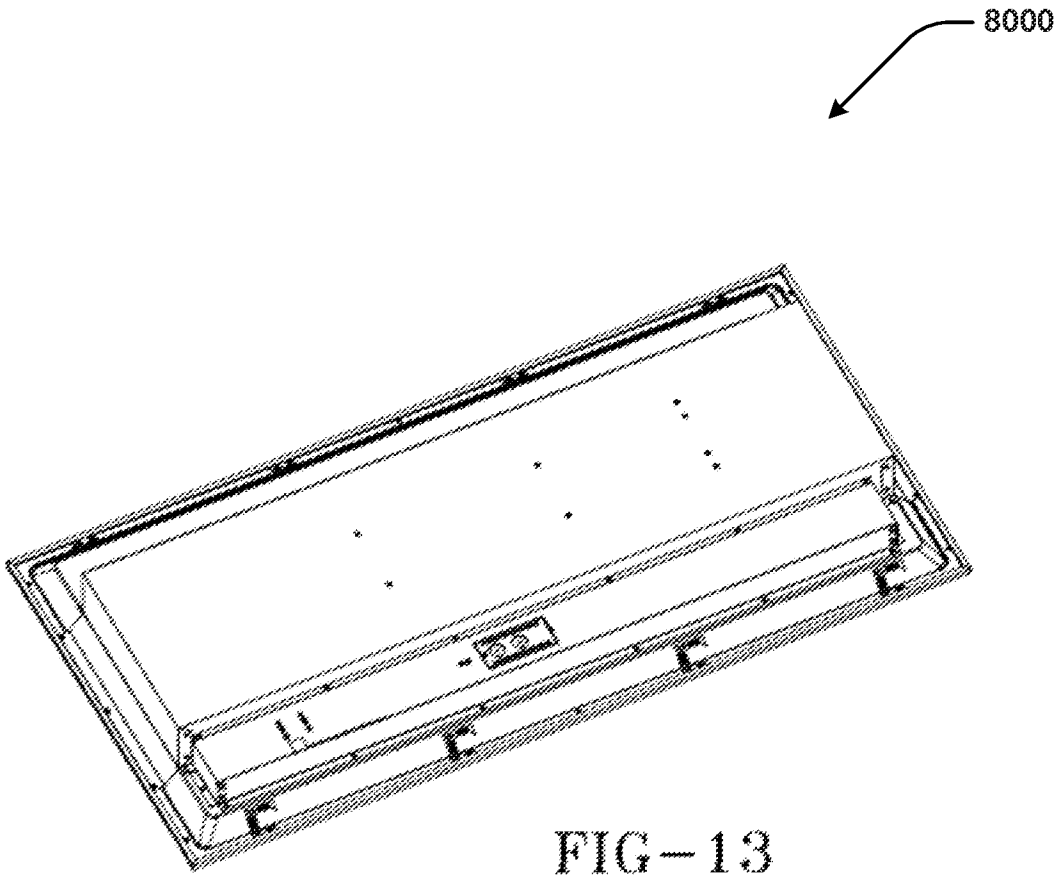
FIG. 13 shows an isometric view with perspective similar to FIG. 8, but without a cut-away.

FIGS. 12 and 13 provide additional isometric views of an example embodiment of model 2×4. It is to be appreciated from these views that no line-of-sight path of UVC treatment can reach a person in a room that is being treated with one or more model 2×4's, and that an indicator is easily visible along with a lockout switch. In FIG. 13, it is to be appreciated that power connections and fastening areas can be provided or attached to frame 8020 or air duct 8060 as may be known in the art.

The invention has been described in detail, with particular emphasis based on the significant portions thereof. Variations and modifications may occur to those skilled in the art from the foregoing description and from the following claims.

The invention claimed is:

1. A combination LED light unit and a UVC sterilization device comprising:
- a light emitting assembly;
- a fan box connected to said light emitting assembly;
- a fan located in said fan box;
- a front cover, a back cover, and side baffles that form an air duct in operative connection with said fan;
- an air inlet disposed on one side of said light emitting assembly for drawing contaminated air into said UVC sterilization device from a space;
- an air outlet disposed on a side of said light emitting assembly different from the disposition of said air inlet; and
- a germicidal and disinfecting air purifier apparatus for eliminating pathogens from said air and disinfecting said air from said light emitting assembly,
- wherein said air outlet directs air treated with said germicidal and disinfecting air purifier apparatus back into the space.

2. A combination LED light unit and a UVC sterilization device according to claim 1 wherein said UVC sterilization device comprises a UVC 2×2 direct/indirect troffer.

3. A combination LED light unit and a UVC sterilization device according to claim 1 wherein said LED light unit comprises a color temperature control switch that selectively controls color temperature of the light emitted by the light emitting assembly.

4. A combination LED light unit and a UVC sterilization device according to claim 1 wherein said UVC sterilization device comprises a UVC sterilization lamp that is within a cavity, and wherein the UVC sterilization lamp comprises a UVC-LED, and one or more walls of the cavity comprise a substrate for sterilizing air flowing through said cavity with an output from the UVC sterilization lamp.

5. A combination LED light unit and a UVC sterilization device according to claim 1 and further including a night light.

6. A combination LED light unit and a UVC sterilization device according to claim 1 and further comprising a control assembly for instituting and completing one or more the following functions:
- air sterilization combined with LED lighting;
- separate LED lighting;
- night lighting; and
- ventilation in combination with at least one of air sterilization, air sterilization with LED lighting, LED lighting, and night lighting;
- wherein the control assembly comprises one or more of a wall switch, remote control switch, automatic temperature control switch, motion switch, humidity switch, and time switch.

7. A combination LED light unit and a UVC sterilization device according to claim 1, wherein the air inlet draws contaminated air into said UVC sterilization device from the space through the front cover; and said air outlet directs air treated with said germicidal and disinfecting air purifier apparatus back into the space through the front cover.

8. A combination LED light unit and a UVC sterilization device according to claim 1, wherein the inlet is defined at one end of the air duct, the air outlet is defined at another end of the air duct, and the air outlet is disposed on a side of the front cover different from the disposition of the air inlet.

9. A combination LED light unit and a UVC sterilization device according to claim 1, further comprising a separator forming the air duct, wherein the side baffles and the separator form the air duct in a serpentine manner around the separator.

10. A combination LED light unit and a UVC sterilization device according to claim 9, wherein the germicidal and disinfecting air purifier apparatus includes a UV lamp fastened in the air duct, between the separator and one of the side baffles.

11. A combination LED light unit and a UVC sterilization device according to claim 9, wherein the germicidal and disinfecting air purifier apparatus includes UV lamps fastened to the back cover, at opposite sides of the separator.

* * * * *